US005728032A

United States Patent [19]

Glass

[11] Patent Number: 5,728,032

[45] Date of Patent: Mar. 17, 1998

[54] WEIGHTED FOOTWEAR GARMENT FOR EXERCISE, TRAINING AND/OR THERAPY

[76] Inventor: Alvin Glass, 151 Tamalpais Ave., Mill Valley, Calif. 94941

[21] Appl. No.: 699,523

[22] Filed: Aug. 21, 1996

[51] Int. Cl.[6] ..... A63B 21/06; A63B 23/04

[52] U.S. Cl. ..... 482/105; 487/74; 487/79; 36/132; 36/136; 36/7.2

[58] Field of Search ..... 482/74, 105, 79; 36/132, 136, 7.2, 7.4

[56] References Cited

U.S. PATENT DOCUMENTS

| | | | |
|---|---|---|---|
| 757,983 | 4/1904 | Vaile | 482/105 |
| 3,114,982 | 12/1963 | McGowan . | |
| 4,458,432 | 7/1984 | Stempski | 36/136 X |
| 5,514,056 | 5/1996 | Ronca et al. . | |

FOREIGN PATENT DOCUMENTS

| | | | |
|---|---|---|---|
| 2535211 | 5/1984 | France | 482/105 |
| 2139103 A | 11/1984 | United Kingdom . | |

*Primary Examiner*—Richard J. Apley
*Assistant Examiner*—John Mulcahy

[57] ABSTRACT

A removable stretch fabric garment (3) with four pockets (4, 5, 6,7) for containing weights (4*a*, 5*a*, 6*a*, 7*a*) is attached to the user's athletic or conventional shoe (2) for the purpose of exercising, training and/or receiving therapy. The weights are contoured to match the shape of that portion of the shoe which they overly and they are secured in their respective pockets by releasable adhesive band closures. A durable vinyl sole (8) connected to the toe portion of the footwear garment grips the toe segment of the shoe and forms a partial undersurface for the garment helping to secure the garment to the shoe.

4 Claims, 3 Drawing Sheets

WEIGHTED FOOTWEAR GARMENT FOR EXERCISE, TRAINING AND/OR THERAPY

BACKGROUND

1. Field of Invention

This invention relates to a removable garment that contains weights which fit around an athletic or conventional shoe and allows for total unrestricted mobility for use in exercise, training and/or therapy.

2. Description of Prior Art

There are a number of weight devices for exercising that can be connected to a leg or attached to a shoe or foot and used principally for the purpose of improving strength in the limb, but they are generally limited to use in a stationary position. One of the exceptions includes ankle cuff weights which are used by some runners and power walkers and do allow for unrestricted mobility of the limb. However, they usually cannot be sufficiently secured to the ankle to avoid movement while running, jumping or walking. This movement of the cuff weights while engaged in the above activities may result in skin irritation as well as other potential injuries. U.S. Pat. No. 5,514,056 to Ronca addresses this issue by firmly securing a weight apparatus to the lower leg proximal to the ankle. The fact that both of these weight devices are located at the ankle or proximal to it precludes their capability of strengthening the lower leg muscles whose tendons insert on the foot and/or toes. In addition both of these devices are likely to be perceived as an unnatural encumbrance around the lower limbs of the user.

There are however, two weight devices that can be attached to a shoe and allow for unrestricted mobility of the foot and limb while performing aerobic exercises including activities such as running and/or walking. They are U.S. Pat. No. 3,114,982 to McGowan and G.B. patent 2,139,103 to Rogers. U.S. Pat. No. 3,114,982 allows for weight adjustments, easy attachment on and off of a shoe and is secured sufficiently to the shoe so that walking or running is relatively unimpaired. The disadvantage of this device is that it does require alteration of the shoe by requiring snaps to be permanently attached to the shoe so that the weights can be secured to it. The expense incurred and the disfigurement of an athletic shoe resulting from snaps being permanently attached to it has probably limited it's acceptance and use by exercise enthusiasts. Another disadvantage is that the weights with this device are confined to just the lateral side of the shoe. This results in an imbalance of weight distribution requiring excess effort on the part of the peroneus longus and brevis muscles which turn the foot out. It offers no resistance to the tibialis posterior which turns the foot in and little resistance to the tibialis anterior which raises the foot up nor does it provide resistance to the extensor digitorum longus, brevis and extensor hallicus longus all of which elevate the toes. This imbalance in strengthening primarily the peroneus longus and brevis muscles that turn the foot out could contribute to the development of a flat foot. Though, G.B. patent 2,139,103 obviates this imbalance problem it limits the weight distribution to just two locations, one on the lateral side of the shoe and the other on the and medial side. Rather than snaps, the weights with this device are secured to the shoe with laces and a strap. In addition to the disadvantage of having only two sites for weight distribution there is another disadvantage of this device and that relates to the use of laces. In order to secure this device to a shoe and then remove it from the shoe a rather time consuming and tedious lacing and unlacing process is necessary since both the weighted device as well as the shoe have to be laced and unlaced together.

It is a recognized fact that the more distal from the joint center that a weight is placed the greater the work load or resistance will be in moving the respective limb segment through its range. Weights located more distal on a limb, i.e. the foot, than weights of equal density and mass located more proximal on the lower leg or thigh will necessitate greater muscular effort and in so doing enhance the users strengthening and conditioning regimen. Consequently, a need exists for taking advantage of this principal in which weights can be secured to the most distal parts of an appendage such as the foot and particularly the toe portion of the foot without restricting mobility of any of the joints of the limb and especially the toe joints.

The present invention fulfills the needs present in the prior art, by providing a unique weight device as defined in the following description and claims.

SUMMARY OF THE INVENTION

The present invention is a simple-slip on slip-off multiple weight attachment device that requires no alteration of the host shoe and provides an evenly balanced and a non-encumbrance form of resistance to the user. It is comprised of a garment, made of a stretch fabric, that encircles the users shoe and contains a series of compartments to accommodate or hold their respective weights. The garment is secured to the shoe by pulling it over the edge of the toe section and stretching it around the heel portion of the shoe. Their are four compartments which are pockets that are created by stitching two layers of the garment material together. They include a toe, heel and two side pockets, medial and lateral, all of which have releasable adhesive fabric closures to help retain the weights within them. A vinyl sole is stitched to the undersurface of the distal toe portion of the garment providing additional gripping across the toe section of the shoe. The toe, sides and heel weights are all contoured to assume the shape of that segment of the shoe to which they are applied.

OBJECTS AND ADVANTAGES

Objects and advantages of the present invention are:

(a) to provide a readily removable and easy to put on weighted footwear garment for the purpose of exercise, training or therapy that does not require any form of alteration of the host shoe.

(b) to provide a readily removable and easy to put on footwear weighted garment for the purpose of increasing stability in those with balance and gait disturbances due to certain neurological impairments.

(c) to provide closures on each of the pockets to allow for exchange of varying density weights as needed and to secure the weights to the footwear garment.

(d) to provide a more physiologically balanced resistance for the muscles of the lower extremity, particularly for those that control the foot, such as the dorsi and plantar flexors as well as the invertors and evertors plus the toe extensors.

(e) to provide for total unrestricted movement at the metatarsal phalangeal joints and the ankle joint.

(f) to provide a means of improved weight control by burning more calories through increased oxygen consumption with the use of the weighted footwear garment.

(g) to provide a means of achieving optimal peak performance through a progressive weight resistance training program utilizing the weighted footwear garment.

Additional objects and advantages of this simple to use and inexpensive to manufacture weighted footwear garment will be made apparent from the ensuing description and drawings.

BRIEF DESCRIPTION OF THE DRAWINGS

In the drawings, the weights have the same identical number as their corresponding compartment or pocket but are identified individually by alphabetic suffixes.

REFERENCE NUMERALS IN DRAWINGS

Figure 1:
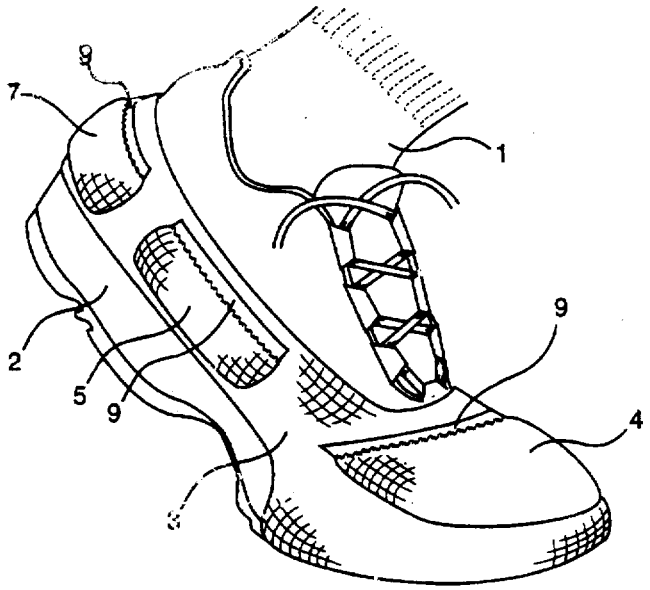
FIG. 1 is a side view that shows the lower leg and ankle in an athletic shoe that has the weighted footwear garment attached to it.

1. Lower leg and ankle
2. Athletic shoe
3. Footwear garment
4. Toe pocket
4*a* Right toe weight
4*b* Left toe weight
5. Lateral side pocket
5*a* Lateral side pocket
6. Medial side pocket
6*a* Medial side weight
7. Heel pocket
7*a* Heel weight
8. Vinyl sole
9. Pocket closures

DESCRIPTION

FIGS. 1 to 5

Figure 2:
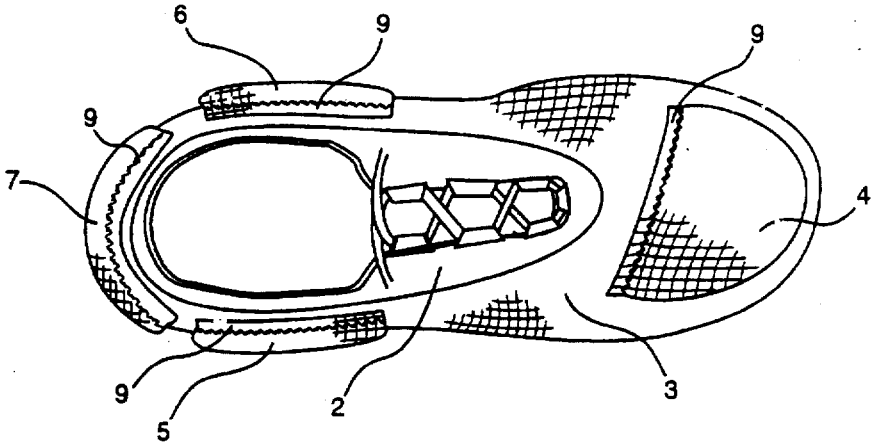
FIG. 2 is an overhead view of the footwear garment that shows the four pockets incorporated into it. The hash marks signify closures for each of the pockets.

Referring to the drawings wherein a preferred embodiment of the invention is illustrated in FIG. 1. The lower leg and ankle 1 with the foot in an athletic shoe 2 is depicted in an active pre-toe off walking or running position. FIG. 1 and 2 reveal the footwear garment 3 with pockets 4, 5, 6 and 7. The footwear garment is made of a stretch fabric giving it a definite elastic quality. This elasticity contributes to a tight and secure fit as the garment is stretched taut across the toes and around the heel of the shoe. The length of the garment need only be slightly less than the length of the shoe to assure an adequate and secure fit. Selection of garment sizes from small, medium, large and extra-large suffice to match most if not all available shoe sizes. The pockets 4, 5, 6 and 7 are sewn onto the garment and are made of the same stretch fabric material that make up the footwear garment.

Figure 4:
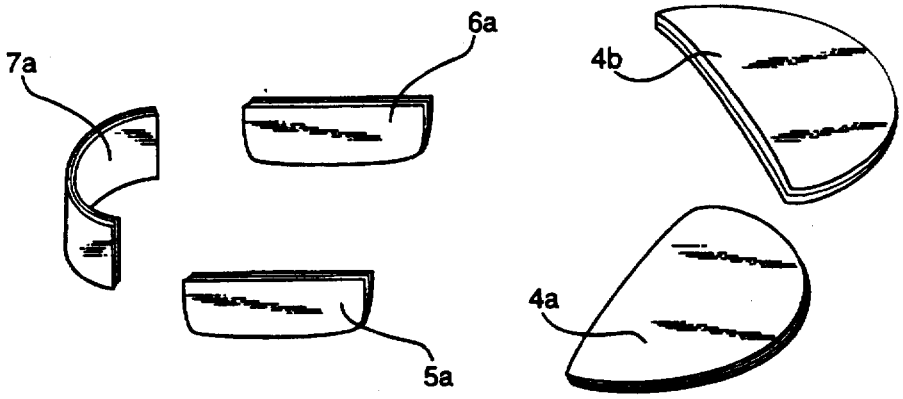
FIG. 4 shows the toe weight, medial and lateral side weights plus the heel weight that are placed in the pockets of the footwear garment.
Figure 5:
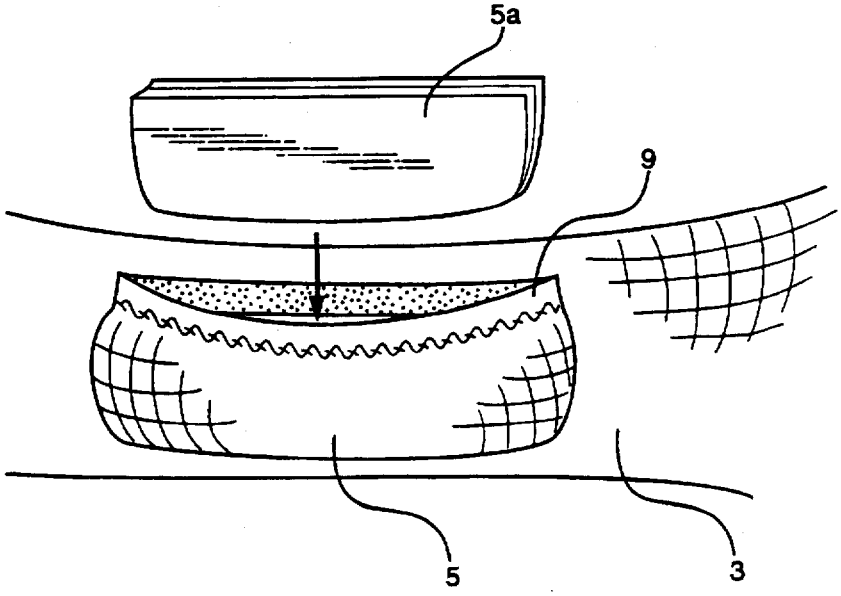
FIG. 5 shows a side pocket opened in order to accomodate its respective side weight.
Figure 6:
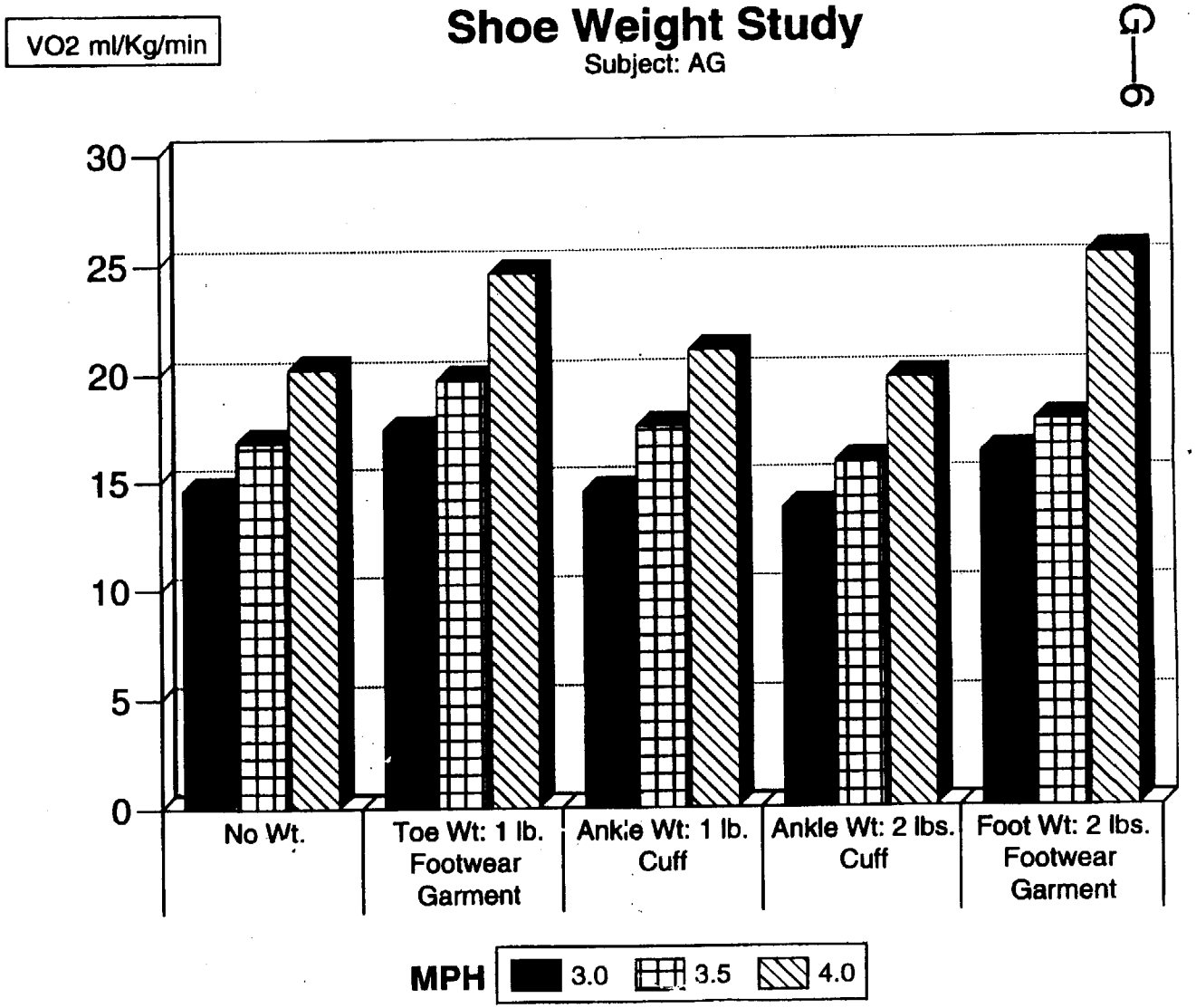
FIG. 6 is a bar graph showing the oxygen consumption differences with the weighted footwear garment versus no weights and then equal weighted ankle cuffs while walking at different speeds on a treadmill.

The hash marks 9 appearing at the top of the pockets 4, 5, 6 and 7 in FIGS. 1, 2 and 5 represent their closures. The closures consist of two complementary bands that are sewn to the inner and outer top edges of the pockets 4, 5, 6 and 7. The two bands are comprised of a nylon material, one of which has a fiber hook type surface while the other has an adhesive pile type surface and when pressed together they remain adhered to each other resulting in closure and thus securing the weights, 4*a*, 4*b*, 5*a*, 6*a* and 7*a* in FIGS. 4 and 5 within their respective pockets. They facilitate easy fastening and unfastening. An example of such a closure is Velcro(®), but it should be understood that other fasteners such as zippers, laces, snaps, straps or buckles may also be employed.

Figure 3:
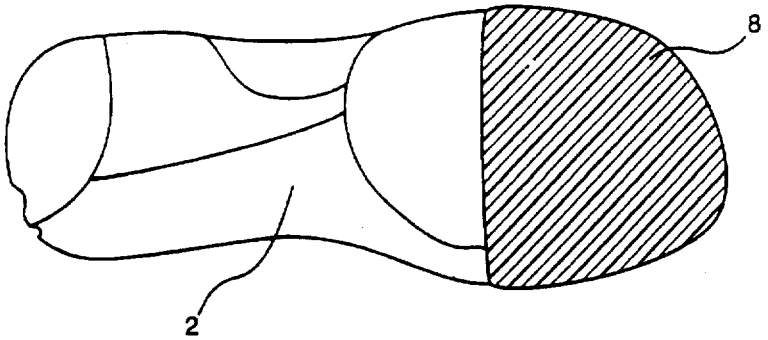
FIG. 3 is a bottom view that shows the undersurface of the shoe with the vinyl sole that attaches the footwear garment to the toe segment of the shoe.

An additional embodiment shown in FIG. 3 is a vinyl sole 8 which is sewed to the distal toe section of the footwear garment 3. It forms the only undersurface of the garment and allows it to grip the toe portion of the shoe while the opposite end of the garment is stretched taut over the heel section thus securing the garment to the shoe 2. stretched taut over the heel section thus securing the garment to the shoe 2.

Another embodiment, are the weights 4*a*, 4*b*, 5*a*, 6*a* and 7*a* in FIGS. 4 and 5 which are made of lead or other heavy material and are shaped to anatomically match the corresponding segment of the foot and shoe to which they are attached. Thus the toe weights 4*a* and 4*b* are contoured to match the convexity of the shoe's toe section. The side weights, lateral and medial; 5*a* and 6*a* are also contoured to be slightly convex in order to correspond to the shape of the sides of the shoe to which they are attached. The heel weight 7*a* is contoured to be convex as well in order to correspond to the heel section of the shoe.

The distal end of the toe weights 4*a* and 4*b* are rounded to correspond to the distal toe section of the shoes. The proximal end, towards the ankle, is slanted fifteen degrees so that its' short medial end corresponds to the first metatarsal phalangeal joint of the big toe while the longer lateral end corresponds to the fifth metatarsal phalangeal joint of the little toe. This incline of the proximal end of the toe weight allows for unrestricted flexion of the metatarsal phalangeal joints while participating in a variety of physical activities including running and walking. The density, mass and dimensions for all of the weights will vary depending on the size, weight and conditioning of the user and the application intended. For adult use though; toe, heel and side weights 4*a*, 4*b*, 7*a*, 5*a* and 6*a* may start at one quarter of a pound or lower and go up to one or two pounds or in some instances even higher.

The results of a preliminary energy expenditure study shown in FIG. 5 suggests significant increased oxygen consumption levels with the one and two pound weighted footwear garment compared to no weights and equal weighted ankle cuffs while on a treadmill at varying walking speeds of 3, 3.5 and 4 miles per hour.

SUMMARY, RAMIFICATIONS AND SCOPE

This invention, an easy slip on and slip off weighted footwear garment, provides distinct physiological advantages over other weight devices in a wide array of exercises and training activities as well as certain therapeutic treatment regiments. The weighted footwear garment enables one to expend increased energy and hence burn more calories in a variety of aerobic exercises and/or physical activities some of which include running, power walking and treadmill use as shown in FIG. 5. The increase in energy expenditure can be attributed to an increased work load resulting from a greater moment of force that occurs with the toe weight placement being more distal to the ankle fulcrum with the footwear garment as opposed to other weight devices being more proximal with their weights on the sides of the shoe or around the ankle or even located higher on the limb.

It also serves as a training device for a number of competitive sports as well as performing arts activities and may even be used as a therapeutic device in treating patients with certain neurological disorders. Football, baseball, basketball players as well as dancers and participants in martial arts, track and field as well as other physical activity events may find that their speed, strength and endurance are significantly improved following non-contact training with the weighted footwear garment. Training programs that start with the lightest weights and gradually progress to heavier weights are likely to lead to substantial gains in speed, endurance and strength. Removal of the weighted footwear garment at the time of the competitive event could greatly assist the participant in achieving peak performance when it is most desired.

Certain neuro-musculoskeletal disorders resulting in weakness of the lower limb can be improved with strengthening exercises that are best served under the direction of a physical therapist. An example would be a patient with weakness in just their dorsiflexors and toe extensors which are the muscles that pull the foot and toes up. In this instance the therapist would utilize only the toe weight in the exercise program and instruct the patient in regard to the frequency and number of repetitions to be done in a static seated or supine position to achieve maximum strengthening. An additional advantage of this invention is that the patient with the therapist's supervision can learn to use the weighted foot wear garment functionally. The patient is then able to walk distances within his or her own tolerance with the toe weight in place so that recovery of strength in the affected muscles is facilitated.

Some of these disorders result not only in weakness but may cause loss of position sense and/or loss of balance and coordination. Another therapeutic application besides strengthening weak muscles is the attempt to stabilize gait and balance in patients with cerebellar disease or injury who suffer from ataxia (imbalance). Here, the therapist through a series of trials with different weights would be able to determine the most effective combinations and positions for the weights to obtain maximal stability before recommending the exact amount to be permanently attached to the patient's shoes by an orthotist or shoemaker. The selective addition of weights to the shoes of some patients with sensory impairment and/or balance problems may help to restore their stability and enable them to regain safer independent ambulation.

Though, many specificities have been described they should not be construed as limiting the scope of this invention but merely as a means of illustrating some of the presently preferred embodiments of this invention. An example is whereby the contoured toe weight may be retained by a strap or clip on attachment that fits around or onto the toe weight and then is secured to the sole of the shoe or a weight device other than the weighted footwear garment.

Thus the scope of the invention should be determined by the appended claims and their legal equivalents rather than by the examples given.

I claim:

1. A removable stretch fabric footwear garment for use as a weighted shoe attachment for running, power walking, exercise, training or therapy comprising a loop of stretch fabric adapted to fit snugly over a shoe, the loop having an upper opening to accommodate at least the ankle of a user and a lower opening to accommodate at least the heel of a shoe, the loop having on one end a toe portion, medal and lateral side portions and at it's opposite end a heel portion, the toe portion having an upper section made of stretch fabric and a lower section each attached to the upper and lower edges respectively of the toe portion of said garment so as to fit tightly around the toe of a shoe, the lower portion comprising a sole, each of said upper section, said medial and lateral side portions and heel portion having pockets for carrying weights attached thereto and each of said pockets having a closure for holding weights securely therein.

2. The stretch fabric footwear garment of claim 1 wherein said lower section connected to the toe portion of said garment is made of vinyl.

3. The stretch fabric footwear garment of claim 1 wherein said toe portion, medial and lateral side portions and heel portion having said pockets containing weights which are removable and made of lead or other material.

4. The stretch fabric footwear garment of claim 1 wherein the toe pocket substantially covers said upper section both of which are made of stretch fabric.

* * * * *